US006805975B2

(12) United States Patent
Sato et al.

(10) Patent No.: US 6,805,975 B2
(45) Date of Patent: Oct. 19, 2004

(54) STEEL SHEET FOR PROCELAIN ENAMELING AND METHOD FOR PRODUCTION THEREOF, AND ENAMELED PRODUCT AND METHOD FOR PRODUCTION THEREOF

(75) Inventors: Fumiaki Sato, Osaka (JP); Toshihira Hamada, Osaka (JP); Shuzo Oda, Osaka (JP); Yoshihiro Jono, Osaka (JP); Takahiro Hayashida, Yamaguchi-ken (JP); Junichi Fujimoto, Yamaguchi-ken (JP); Masao Komai, Yamaguchi-ken (JP)

(73) Assignees: Ferro Enamels (Japan) Limited, Osaka (JP); Toyo Kohan Co., Ltd., Tokyo (JP)

( * ) Notice: Subject to any disclaimer, the term of this patent is extended or adjusted under 35 U.S.C. 154(b) by 0 days.

(21) Appl. No.: 10/204,348

(22) PCT Filed: Dec. 17, 2001

(86) PCT No.: PCT/JP01/11026

§ 371 (c)(1),
(2), (4) Date: Jan. 16, 2003

(87) PCT Pub. No.: WO02/052055

PCT Pub. Date: Jul. 4, 2002

(65) Prior Publication Data

US 2003/0162052 A1 Aug. 28, 2003

(30) Foreign Application Priority Data

Dec. 26, 2000 (JP) ..... 2000-395600

(51) Int. Cl.[7] ..... B32B 15/04; C25D 3/12

(52) U.S. Cl. ..... 428/680; 428/621; 428/632; 428/684; 428/685; 428/681; 428/660; 205/238; 205/228; 205/255

(58) Field of Search ..... 428/632, 633, 428/684, 685, 678, 680, 681, 660, 621; 205/238, 228, 255

(56) References Cited

U.S. PATENT DOCUMENTS 5,993,974 A 11/1999 Fukushima et al

OTHER PUBLICATIONS

Sayanagi Shiro, "Production of Steel Sheet for Porcelain Enameling Excellent in Deep Drawability," Publication No. 07–118755, May 9, 1995, On–line JAPIO Abstract of Japanese patent.

*Primary Examiner*—Jennifer McNeil
(74) *Attorney, Agent, or Firm*—Browdy and Neimark, P.L.L.C.

(57) ABSTRACT

Steel sheet for porcelain enameling capable of realizing excellent enamel adhesion with the steel sheet by direct-on enameling once is provided by using a Ti-added steel sheet; there are also a method for producing the same, as well as a porcelain enamel product and the method for producing the same. A steel sheet for porcelain enameling is produced by providing a Ni—Mo alloy plating film on a Ti-added steel sheet containing 0.01% by weight (wherein, % represents "% by weight" hereinafter) or less of C, 0.5% or less of Mn, 0.04% or less of P, 0.04% or less of S, 0.01 to 0.50% of Ti, and balance Fe accompanied by unavoidable impurities, and by then performing heat treatment thereto to control the content of Ni, Mo, and Fe present in the surface of the steel sheet in a predetermined range, porcelain enamel is applied once and fired.

5 Claims, No Drawings

STEEL SHEET FOR PROCELAIN ENAMELING AND METHOD FOR PRODUCTION THEREOF, AND ENAMELED PRODUCT AND METHOD FOR PRODUCTION THEREOF

TECHNICAL FIELD

The present invention relates to steel sheet for porcelain enameling, method for producing the same, porcelain enamel products and a method for producing the same. In further detail, the invention relates to steel sheet for porcelain enameling having excellent adhesion with enamel and a method for producing the same, as well as to a porcelain enamel product and a method for producing the same, which enables excellent enamel adhesion by "direct-on" enameling of cover coat enamel on Ti-added steel sheet.

BACKGROUND ART

Porcelain enamel products are widely used as kitchen and table-top articles, components of heating appliance and components of cooking appliance, bathtubs, interior and exterior materials of buildings, and the like. Enamel products are generally produced by firing twice; a ground coat enamel is first applied on the steel sheet and fired, a cover coat enamel is further applied thereon, and fired again. In order to reduce the production cost, however, a production method of direct enameling for only once, i.e., "direct-on enameling", comprising providing the cover coat enamel directly on the steel sheet followed by firing is employed. However, in the production method of direct-on enameling, it is necessary to perform pretreatment oh the steel sheet before enameling, such as intense pickling and Ni dipping treatment. Further, as a steel sheet for obtaining favorable adhesion of the enamel product with the steel sheet, a rolled sheet of high oxygen steel containing oxygen at a high concentration, which is produced by reducing C content in the steel-making stage and produced by continuous casting without performing deoxidation treatment, is widely utilized. However, a high oxygen steel generally suffers poor workability, and its application to usages requiring severe processing is limited.

Japanese Patent Publication No. 24413/1979 discloses that, by coating the surface of a steel material with an alloy of one or two types of metals selected from Ni and Fe with one or two types of metals selected from Mo and W, excellent affinity with the cover coat enamel and adhesion with the cover coat enamel can be obtained. However, there is no description concerning the workability of the steel sheet.

On the other hand, in usages requiring severe workability such as kitchen wares or bathtubs, rolled sheets of Ti-added steel or B-added steel have been used. However, as is disclosed in Japanese Patent Laid-Open No. 140286/1998, although Ti-added steel sheet is superior in workability, black specks defects generate in the enamel layer in case direct-on enameling is performed. Accordingly, the enamel layer had to be formed by means of ground coat enamel finishing or by applying the cover coat and ground enameling in two times.

As described above, there is required a steel sheet for porcelain enameling by reduced production steps and energy consumption, thereby reduced in production cost, yet improved in workability and having an enamel layer with high adhesion even in case direct-on enameling is performed only once.

In the present invention, the objects are to provide steel sheet for porcelain enameling having excellent adhesion with the steel sheet by applying direct-on enameling of cover coat enamel only once and still free of black specks defects, to provide the method for producing the same, as well as to provide a porcelain enamel product and the method for producing the same, in which Ti-added steel sheet is used.

DISCLOSURE OF THE INVENTION

The steel sheet for porcelain enameling according to present invention that solves the problems above is characterized by that it comprises a Ti-added steel sheet containing 0.01% by weight (wherein, % represents "% by weight" hereinafter) or less of C, 0.5% or less of Mn, 0.04% or less of P, 0.04% or less of S, 0.01 to 0.50% of Ti, and balance Fe accompanied by unavoidable impurities, which is obtained by providing thereon a Ni—Mo alloy plating film, and which is then subjected to heat treatment.

The reason for confining each of the components in the steel sheet for porcelain enameling above according to the present invention is as follows.

[C]

From the viewpoint of suppressing the generation of pores and black specks on firing the enamel while assuring favorable workability, the content of C is set to 0.01% or less.

[Mn]

Manganese bonds with S to exhibit effects of suppressing cracking attributed to embrittlement from occurring during hot working; hence, Mn should be incorporated at a concentration of 0.5% or lower. In case the content of Mn exceeds 0.5%, the content of sulfides in the steel decreases as to reduce the degree of surface roughening of the steel sheet during pickling, and it results in a loss of anchoring effect. This leads to a drop in adhesion of enamel.

[P]

Although P improves adhesion, from the viewpoint of suppressing the generation of pores and black specks on firing the enamel, the content thereof is set to 0.04% or lower.

[S]

Sulfur accelerates surface roughening of the steel sheet on pickling as to improve the adhesion of the enamel by anchoring effect. However, S causes cracks due to embrittlement on hot working. Hence, the content of S is constrained to 0.04% or lower.

[Ti]

Titanium should be contained in a range of from 0.01 to 0.50%. In case the content falls outside this range, hardening occurs as to impair moldability.

The steel sheet for porcelain enameling according to the one embodiment of the present invention is characterized by that, in the steel sheet for porcelain enameling the content of elements present in the surface of the steel sheet as measured by an energy-dispersion type X-ray microanalyzer hereinafter referred to as "EDX" is 5 to 75% Ni, 3 to 40% Mo, and 5 to 82% Fe provided that Ni, Mo, and Fe in total is 100%.

Furthermore, the method for producing steel sheet for porcelain enameling according to the one embodiment of the present invention is characterized by that it comprises providing a Ni-Mo alloy plating on the steel sheet described above, followed by applying a heat treatment thereto. Further, the method for steel sheet for porcelain enameling according to one embodiment of the present invention is characterized by that, as the Ni—Mo alloy plating, the plating is performed in such a manner that the plating film contains Ni at a coverage of 1.5 to 20.0 g/m$^2$ and Mo at a coverage of 0.4 to 7.0 g/m$^2$. Furthermore, the method for steel sheet for porcelain enameling according to one embodiment of the present invention is characterized by that the heat treatment is performed in a temperature range of from 500 to 900° C.

Moreover, the porcelain enameled product according to one embodiment of the present invention is characterized by that it comprises an enamel layer provided on one of the steel sheets for porcelain enameling as described above. Then, the method for producing a porcelain enameled product according to one embodiment of the present invention is characterized by that it comprises once applying a cover coat enamel on one of the steel sheets for porcelain enameling as described above, followed by applying firing thereto.

BEST MODE FOR CARRYING OUT THE INVENTION

The mode for carrying out the present invention is described below.

The present invention is based on the findings that, by applying a Ni—Mo alloy plating on a Ti-added steel sheet having a specified composition range and containing ultra-low carbon, and by applying heat treatment thereto in order to control the content of Ni, Mo, and Fe present in the surface of the steel sheet for porcelain enameling in a predetermined range, excellent enamel adhesion properties are obtained even on porcelain enameled products having the enamel provided by direct-on enameling for only once.

The Ti-added steel sheet containing low carbon for use in the present invention has its composition adjusted as such that it should contain 0.01% by weight or less of C, 0.5% or less of Mn, 0.04% or less of P, 0.04% or less of S, 0.01 to 0.50% of Ti, and balance Fe accompanied by unavoidable impurities. A slab is then produced from the steel having its composition adjusted to the range above by means of continuous casting. The resulting slab is then hot rolled, or, hot rolled after re-heating. Then, after pickling and descaling by a known method such as sulfuric acid pickling and the like, the resulting product is cold rolled at a draught of about 50 to 95%, annealed at a temperature of recrystallization temperature or higher but lower than the $Ac_3$ point by means of core box annealing or by continuous annealing process, and subjected to refining rolling at a draught of about 0.1 to 5% to obtain the steel sheet for use in the present invention.

Subsequently, a Ni—Mo alloy plating is provided to the resulting steel sheet. The alloy plating may be performed by either means of electroless plating or electrolytic plating, but from the ease of controlling the alloy composition, preferred is electrolytic plating. As the plating bath, there is used an aqueous solution having supplied thereto Ni ions in the form of a salt of an inorganic acid, such as a sulfate, a nitrate, a halide, etc. and Mo ions in the form of an ammonium salt of a metallic acid salt and the like, having further added thereto, as a complexing agent, an organic acid such as citric acid, tartaric acid, or a malic acid or a salt thereof. Then, after adding an acid or an alkali to the resulting aqueous solution to control the pH in a range of from 2 to 4, and adjusting the bath temperature in a range of from 30 to 50° C., direct current electrolysis is performed at a current density of from 5 to 30 A/dm$^2$ by using a Ni plate as the anode. Preferably, degreasing treatment and pickling treatment are performed on the steel sheet by an ordinary method just before applying the plating above, because the steel sheet before plating tends to be oxidized with passage of time or be brought into contact with oils and fats.

Concerning the components in the coating formed by alloy plating above, the coating contains 1.5 to 20.0 g/m$^2$, preferably 2.0 to 6.0 g/m$^2$ of Ni, and 0.4 to 7.0 g/m$^2$, preferably 1.0 to 2.0 g/m$^2$ of Mo. The content can be obtained by fluorescent X-ray spectroscopy. In case the content of Ni and Mo in the plating should fall outside the range above, favorable adhesion cannot be assured between the enamel and the steel sheet, because the elements Fe, Ni, and Mo in the surface of the steel sheet cannot be pertained in the preferred range on applying heat treatment after plating as described below.

Then, heat treatment is performed after providing the Ni—Mo alloy plating on the steel sheet as described above. The heat treatment is carried out in a manner similar to annealing generally performed on an ordinary steel sheet. As the heat treatment, i.e., as the annealing, there can be used either core box annealing or continuous annealing without any problem. Although depending on the content of Fe, Ni, and Mo pertained on the surface of the steel sheet after heat treatment, the conditions of annealing are, heating in the temperature range of from 500 to 900° C. for a time duration of from 1 minute to 15 hours under a reducing atmosphere of a gaseous decomposed ammonia, more preferably, heating in the temperature range of from 550 to 750° C. for a time duration of from 1 to 8 hours is performed.

In the manner described above, steel sheet for porcelain enameling according to the present invention can be obtained. By the heat treatment described above, Ni and Mo diffuse into the steel sheet, and Ni and Mo undergo mutual diffusion as to change the content of Fe, Ni, and Mo present in the surface of the steel sheet. The content of the elements present in the surface of the steel sheet can be measured by using a surface analyzer of, for instance, EDX. After the heat treatment, the content of Fe, Ni, and Mo present in the surface of the steel sheet is 5 to 75% Ni, 3 to 40% Mo, and 5 to 82% Fe; preferably, 8 to 50% Ni, 5 to 25% Mo, and 35 to 80% Fe, and by adjusting the content of Ni, Mo, and Fe in such a manner that the total thereof should become 100%, an excellent adhesion properties of enamel with the steel sheet can be obtained. That is, by thus performing heat treatment after applying Ni—Mo alloy plating, a Mo—Ni layer containing Fe at a certain concentration or higher is formed on the surface of the plated steel sheet, and thereby a favorable enamel adhesion can be assured.

The steel sheet for porcelain enameling thus obtained as described above can be enameled as it is in the state of flat plate without processing, or may be enameled after shaping and processing it into the desired shape by applying bending and drawing. In general, porcelain enameling is performed by applying, as the ground coat enamel for assuring adhesion, an enamel containing Ni and Co; for instance, a ground enamel containing 15 to 20% of $Na_2O_3$ and $K_2O$, 3 to 6% of $CaF_2$, 3 to 6% of $Al_2O_3$, 13 to 18% of $B_2O_3$, 50 to 55% of $SiO_2$, and 0.3 to 1.5% of CoO and NiO. Then, a cover coat enamel having beautiful appearance is applied. In case of using the steel sheet for porcelain enameling according to the present invention, not only the commonly employed base enamel containing Ni and Co, but also a cover coat enamel free from Ni and Co, for instance, a cover coat enamel generally used in the twice enameling method containing 10 to 15% of $Na_2O_3$ and $K_2O$, 1 to 4% of $CaF_2$, 0 to 3% of $Al_2O_3$, 7 to 13% of $B_2O_3$, 48 to 50% of $SiO_2$, 0 to 2% of MgO and ZnO, and 15 to 20% of $TiO_2$, may be applied by direct-on enameling to obtain excellent enamel adhesion. The condition of enameling is such that, after applying the enamel at a dry thickness in a range of from 80 to 300 $\mu$m, firing is performed by heating in air in the temperature range of from 700 to 900° C. for a time duration of from 1 to 5 minutes. In this manner, a porcelain enamel product of the present invention can be obtained.

EXAMPLES

The present invention is described in further detail by way of examples below.

The steel having the composition shown in Table 1 was molten to obtain 7 types of slabs. The slabs were heated to 1160° C., and were each hot rolled at a finish temperature of 880° C. to obtain each of the hot rolled sheets 2.8 mm in thickness, which were each taken up into a coil at 650° C. Then, while recoiling, descaling and sulfuric acid pickling were applied to the sheet, and after applying cold rolling thereto to obtain a steel sheet 0.5 mm in thickness (i.e., 82% in draught), continuous annealing at 830° C. was applied for 75 seconds, and refining rolling at a draught of 0.5% was performed thereon to obtain cold rolled steel sheet.

After performing alkali degreasing to the cold rolled steel sheet by an ordinary means and by applying pickling thereto by using an aqueous sulfuric acid solution, electric plating of a Ni—Mo alloy was performed under the conditions below by using the following plating bath to obtain coverage as shown in Table 2. Then, by applying heat treatment under the condition shown in Table 2 in gaseous decomposed ammonia, each of the steel sheets for porcelain enameling shown in Table 2 was produced. The content of the elements Fe, Ni, and Mo present in the surface of the steel sheet for porcelain enameling was measured by using EDX. The results are given in Table 2.

TABLE 1

| | Chemical composition of the steels | | | | | |
|---|---|---|---|---|---|---|
| | Chemical composition of steel (% by weight) | | | | | |
| No. of steel | C | Mn | P | S | Ti | Fe and unavoidable impurities |
| A | 0.0050 | 0.16 | 0.027 | 0.027 | 0.070 | balance |
| B | 0.0010 | 0.17 | 0.011 | 0.007 | 0.041 | balance |
| C | 0.0100 | 0.17 | 0.023 | 0.019 | 0.010 | balance |
| D | 0.0016 | 0.50 | 0.019 | 0.040 | 0.023 | balance |
| E | 0.0018 | 0.18 | 0.040 | 0.011 | 0.054 | balance |
| F | 0.0018 | 0.17 | 0.023 | 0.011 | 0.500 | balance |
| G | 0.042 | 0.33 | 0.013 | 0.015 | — | balance |

| | |
|---|---|
| [Plating bath] | |
| Nickel sulfate | 82 g/L |
| Ammonium molybdate | 48 g/L |
| Sodium citrate | 88 g/L |
| [Plating condition] | |
| pH | 3.0 |
| Bath temperature | 40° C. |
| Current density | 20 A/dm$^2$ |
| Anode | Nickel plate |

TABLE 2

| Examples and Comparative Examples | No. of Steel | Steel sheets for porcelain enameling: Coverage of plating Ni (g/m$^2$) | Coverage of plating Mo (g/m$^2$) | Heat treatment conditions Temperature (° C.) | Heat treatment conditions Time (hours) | Content of elements on steel surface (% by weight) Fe | Ni | Mo |
|---|---|---|---|---|---|---|---|---|
| Example 1 | C | 3.63 | 1.25 | 500 | 15 | 23.3 | 56.0 | 20.7 |
| Example 2 | E | 6.00 | 1.54 | 550 | 1 | 7.0 | 72.0 | 21.0 |
| Example 3 | E | 5.02 | 1.55 | 550 | 5 | 10.9 | 66.0 | 23.1 |
| Example 4 | D | 3.57 | 1.21 | 600 | 1 | 11.9 | 64.3 | 23.8 |
| Example 5 | A | 3.25 | 1.20 | 600 | 5 | 15.8 | 56.2 | 28.0 |
| Example 6 | B | 2.00 | 1.00 | 650 | 1 | 23.9 | 53.7 | 22.4 |
| Example 7 | B | 4.79 | 2.00 | 650 | 5 | 37.3 | 44.6 | 18.1 |
| Example 8 | B | 3.14 | 1.23 | 700 | 1 | 36.1 | 43.8 | 20.1 |

TABLE 2-continued

| Examples and Comparative Examples | No. of Steel | Steel sheets for porcelain enameling: Coverage of plating Ni ($g/m^2$) | Coverage of plating Mo ($g/m^2$) | Heat treatment conditions Temperature (° C.) | Heat treatment conditions Time (hours) | Content of elements on steel surface (% by weight) Fe | Ni | Mo |
|---|---|---|---|---|---|---|---|---|
| Example 9 | F | 4.68 | 1.31 | 700 | 5 | 54.5 | 29.8 | 15.7 |
| Example 10 | A | 4.71 | 1.38 | 750 | 1 | 57.2 | 25.1 | 17.7 |
| Example 11 | A | 3.19 | 1.16 | 750 | 5 | 75.1 | 8.8 | 26.0 |
| Example 12 | A | 3.26 | 1.22 | 900 | 0.017 | 6.4 | 82.0 | 11.6 |
| Comp. Ex. 1 | A | 25.32 | 8.32 | 550 | 1 | 2.1 | 76.3 | 21.6 |
| Comp. Ex. 2 | G | 1.48 | — | 950 | 1 | 97.3 | 2.7 | — |
| Comp. Ex. 3 | A | 9.28 | 2.16 | 400 | 1 | 4.8 | 90.4 | 4.8 |
| Comp. Ex. 4 | C | 5.61 | 2.92 | 200 | 1 | 3.3 | 55.4 | 41.3 |

Furthermore, as comparative examples, cold rolled steel sheet nos. A and C of Comparative Examples 1, 3, and 4 were subjected to electric plating using the plating bath under the conditions above to form a plating of Ni—Mo alloy at a coverage shown in Table 2. Further, the cold rolled steel sheet G of Comparative Example 2 was subjected to electric plating using the plating bath under the conditions below to form a plating of Ni at a coverage shown in Table 2, and was further subjected to heat treatment at the conditions shown in Table 2 under gaseous decomposed ammonia. Thus was obtained a steel sheet for porcelain enameling shown in Table 2. The content of Fe, Ni, and Mo present in the surface of the resulting steel sheet for porcelain enameling was measured by EDX. The results are given in Table 2.

| [Plating bath] | |
|---|---|
| Nickel sulfate | 300 g/L |
| Nickel chloride | 45 g/L |
| Boric acid | 30 g/L |
| [Plating condition] | |
| pH | 4.0 |
| Bath temperature | 55° C. |
| Current density | 10 $A/dm^2$ |
| Anode | Nickel plate |

To each of the steel sheets for porcelain enameling thus obtained as Examples and Comparative Examples above, cover coat porcelain enamel (No. 02-1103/100, produced by FERRO ENAMEL (JAPAN) LIMITED) was applied as such to result in a fire thickness of about 120 $\mu$m. After drying, the resulting products were each fired at 800° C. for 3 minutes under the atmosphere in a firing furnace to obtain the samples of porcelain enamel products. The samples were then evaluated in the manner described below on the adhesion of the porcelain enamel and on the appearance.

Evaluation of Properties

<Adhesion>

The adhesion of the porcelain enamel was evaluated by PEI method.

PEI Method

A steel ball 25 mm in diameter was pressed against the flat sheet portion of the sample, and the sample was deformed by applying a force of 8.9 kN using a hydraulic hand press, and 169 metallic conductive probes were pressed to the deformed portion to apply electric current. The insulation was evaluated in accordance with the following equation.

$$\text{Insulation } (\%) = (n/169) \times 100,$$

where, n represents the number of probes showing no conduction. From the value of insulation (%) thus obtained by the equation above, the adhesion of the enamel was evaluated in accordance with the following evaluation standard.

Excellent: Insulation=100%

Good: 85%<Insulation<100%

Fair: 80%≦Insulation≦85%

Poor: Insulation<80%

The results are given in Table 3.

<Appearance>

The appearance of the enamel was evaluated by cutting out ten test pieces each 30 cm×30 cm in size from a single sample. The test pieces were each visually observed for the generation of pores, black specks, and cracking and fish scales, and the number of the generated defects was counted. Evaluation was made in accordance with the standard as follows.

Pores and Black Specks

Good: No pores and black specks were observed.

Fair: Less than ten pores or black specks in total were observed on ten test pieces.

Poor: Ten or more pores or black specks in total were observed on ten test pieces.

Cracking and Fish Scales

Good: No cracking and fish scale were observed.

Fair: Less than ten cracking and fish scales in total were observed on ten test pieces.

Poor: Ten or more cracking and fish scales in total were observed on ten test pieces.

The results are given in Table 3.

As shown in Table 3, the steel sheet for porcelain enameling according to the present invention enables porcelain enameled products produced by direct-on enameling of overcoat porcelain enamel by only one time having excellent enamel adhesion and appearance.

On the contrary, in the case of Comparative Examples 1 to 4, the adhesion of enamel was poor, and ten or more pores, black specks, cracking and fish scales were observed on the appearance.

TABLE 3

Results of Evaluated Properties

| Examples and Comparative Examples | Result of Evaluated Properties: Adhesion of enamel | Appearance: Pores and black specks | Appearance: Cracking and fish scales |
|---|---|---|---|
| Example 1 | Excellent | Good | Good |
| Example 2 | Excellent | Good | Good |
| Example 3 | Excellent | Good | Good |
| Example 4 | Excellent | Good | Good |
| Example 5 | Excellent | Good | Good |
| Example 6 | Excellent | Good | Good |
| Example 7 | Excellent | Good | Good |
| Example 8 | Excellent | Good | Good |
| Example 9 | Excellent | Good | Good |
| Example 10 | Excellent | Good | Good |
| Example 11 | Excellent | Good | Good |
| Example 12 | Good | Good | Good |
| Comp. Ex. 1 | Poor | Poor | Poor |
| Comp. Ex. 2 | Fair | Poor | Fair |
| Comp. Ex. 3 | Fair | Poor | Poor |
| Comp. Ex. 4 | Poor | Poor | Poor |

Production of Porcelain Enamel Products

Porcelain enamel products were produced in the following manner by using the steel sheet for porcelain enameling according to the present invention.

The steel sheets for porcelain enameling given as Examples 4 and 11 in Table 2 were each pressed into a shape of a saucepan having an inner diameter of 160 mm and a depth of 110 mm, and into a shape of the top plate of an oil stove 220 mm in length, 400 mm in width, and 8 mm in depth. To the base metal for enameling thus obtained, porcelain enamel was applied in 4 methods, and the resulting products were fired to obtain the porcelain enamel products.

<Porcelain Enamel>

Ground coat enamel: 03-1226, produced by FERRO ENAMELS (JAPAN) LIMITED

Overcoat enamel: 02-2105, produced by FERRO ENAMELS (JAPAN) LIMITED

<Enameling>

(1) Ground Coat Enamel Finish (Applying Ground Coat Enamel Once–Firing Once)

To the saucepan and the oil stove top plate obtained by press working above as the base metal for enameling, the ground coat enamel 03-1226 was applied to obtain a fired coating about 100 μm in thickness. The resulting product was dried and fired in a firing furnace at 820° C. for 5 minutes.

(2) Cover Coat Enamel Finishing on Ground Coat Enamel-finished Surface (Applying Enamel Twice–Firing Twice)

After applying a ground coat enamel in the same manner as above and firing, the cover coat enamel above, 02-2105, was applied to the surface in such a manner that the fired thickness of about 100 μm would result. The resulting product was dried and fired in a firing furnace at 820° C. for 5 minutes.

(3) Ground Coat Enamel+Cover Coat Enamel Finishing (Applying Enamel Twice–Firing Once)

To the same saucepan and the oil stove top plate as above obtained as the base metal for enameling, the ground coat enamel 03-1226 described above was applied to obtain a fired coating about 80 μm in thickness. Then, without firing, the cover coat enamel described above, 02-2105, was applied in such a manner to obtain a fired coating about 120 μm in thickness. The resulting product was dried and fired in a firing furnace at 820° C. for 5 minutes.

(4) Cover Coat Enamel Finishing (Direct-on Applying Cover Coat Enamel–Firing Once)

To the same pan and the oil stove top plate as above obtained as the base metal for enameling, the cover coat enamel described above, 02-2105, was applied in such a manner to obtain a fired coating about 120 μm in thickness. The resulting product was dried and fired in a firing furnace at 820° C. for 5 minutes.

The saucepans and the oil stove top plates obtained as the enamel products according to (1) to (4) above were subjected to the evaluation for adhesion and appearance.

TABLE 4

Evaluation Results on Enamel Products

| Enameling method | Porcelain Enamel product | Appearance | Adhesion |
|---|---|---|---|
| Ground coat enamel finishing (Applying ground coat enamel once - firing once) | Saucepan<br>Top plate of oil stove | Good;<br>Free from pores, black specks pinholes, cracking and fish scales, etc. | Good |
| Cover coat enamel finishing on ground coat enamel-finished surface (Applying enamel twice - firing twice) | Saucepan<br>Top plate of oil stove | | |
| Ground coat enamel + Cover coat enamel finishing (Applying enamel twice - firing once) | Saucepan<br>Top plate of oil stove | | |
| Cover coat enamel finishing (Direct-on applying cover coat enamel - firing once) | Saucepan<br>Top plate of oil stove | | |

<Adhesion>

Similar to the evaluation performed on the steel sheet for porcelain enameling described hereinbefore, PEI method was used for the evaluation.

<Appearance>

The appearance of the enamel products was visually observed to evaluate the generation of pores, black specks, pinholes, cracking and fish scale, etc. The results are given in Table 4.

As shown in Table 4, similar to the case of applying firing a ground coat enamel and applying a cover coat enamel, or to the case of twice enameling, i.e., to the case of applying a ground coat enamel and then applying a cover coat enamel and firing, the enamel products according to the present invention, which are obtained by direct-on enameling of a ground coat enamel or a cover coat enamel, exhibit excellent enamel adhesion and appearance.

Furthermore, the steel sheet for porcelain enameling according to the present invention is applicable, not only as the base metal of porcelain enamel products, but also as base for forming thereon inorganic or organic coating films.

Industrial Applicability

As described above, the present invention enables a steel sheet for porcelain enameling having excellent workability and enamel adhesion by applying a Ni—Mo alloy plating to a Ti-added steel sheet containing ultra-low carbon and having its composition specifically adjusted, and then performing heat treatment thereto to control the amount of Ni, Mo, and Fe present on the surface of the steel sheet in a predetermined range. By then providing a cover coat enamel by direct-on enameling once and firing, superior porcelain enamel products having excellent enamel adhesion and appearance free from pores, black specks, cracking and fish scales can be obtained.

What is claimed is:

1. A steel sheet for porcelain enameling comprising a Ti-added steel sheet containing 0.01% by weight (wherein, % represents "% by weight" hereinafter) or less of C, 0.5% or less of Mn, 0.04% or less of P, 0.04% or less of S, 0.01 to 0.50% of Ti, and balance Fe accompanied by unavoidable impurities, having provided thereon a Ni—Mo alloy plating film, and having subjected to heat treatment thereafter, wherein the content of elements present in the surface of the steel sheet for porcelain enameling as measured by an energy-dispersion type X-ray microanalyzer is 5 to 75% Ni, 3 to 40% Mo, and 5 to 82% Fe, provided that Ni, Mo and Fe in total is 100%.

2. A porcelain enameled product comprising an enamel layer provided on the steel sheet for porcelain enameling as claimed in claim 1.

3. A method for producing a steel sheet for porcelain enameling, comprising providing a Ni—Mo alloy plating on the steel sheet described in claim 1, followed by applying a heat treatment in a temperature range of from 500 to 900° C.

4. A method for producing a steel sheet for porcelain enameling as claimed in claim 3, wherein as the Ni—Mo alloy plating, the plating is performed in such a manner that the plating film contains Ni at a coverage of 1.5 to 20.0 $g/m^2$ and Mo at a coverage of 0.4 to 7.0 $g/m^2$.

5. A method for producing a porcelain enameled product, comprising once applying a cover coat enamel on the steel sheet for porcelain enameling as claimed in one of claims 3 to 4, followed by applying firing thereto.

* * * * *